175-50 SR

9/23/80 XR 4,223,746

United States Patent [19]

Tanguy et al.

[11] 4,223,746

[45] Sep. 23, 1980

[54] SHOCK LIMITING APPARATUS

[75] Inventors: Denis R. Tanguy, Houston; Larry J. Leising, Rosenberg, both of Tex.

[73] Assignee: Schlumberger Technology Corporation, New York, N.Y.

[21] Appl. No.: 7,526

[22] Filed: Jan. 29, 1979

[51] Int. Cl.[2] ..... E21B 17/02; E21B 47/00; F16F 9/18

[52] U.S. Cl. ..... 175/40; 175/50; 175/321; 175/45; 267/125; 267/137

[58] Field of Search ..... 175/321, 320, 40, 45, 175/48, 50; 166/64, 250; 267/125, 137

[56] References Cited

U.S. PATENT DOCUMENTS

| | | | |
|---|---|---|---|
| 2,812,717 | 11/1957 | Brown | 175/321 X |
| 3,149,490 | 9/1964 | Clements et al. | 175/50 X |
| 3,225,566 | 12/1965 | Leathers | 175/321 X |
| 3,606,297 | 9/1971 | Webb | 175/321 X |
| 3,714,831 | 2/1973 | Quichaud et al. | 175/40 X |
| 3,963,228 | 6/1976 | Karle | 267/125 X |
| 4,055,338 | 10/1977 | Dyer | 175/321 X |
| 4,133,516 | 1/1979 | Jürgens | 175/321 X |
| 4,145,034 | 3/1979 | Dyer | 267/125 |

*Primary Examiner*—Stephen J. Novosad
*Attorney, Agent, or Firm*—David L. Moseley; William R. Sherman

[57] ABSTRACT

In accordance with an illustrative embodiment of the present invention, a shock limiting apparatus for mounting an instrumentality in a drill collar comprises piston and cylinder means subject to hydrostatic well fluid pressure for preventing longitudinal movement of the instrumentality within the drill collar unless a predetermined level of deceleration is exceeded, and a combination of hydraulic damping and Coulomb friction means for dissipating kinetic energy of the instrumentality in a substantially uniform manner when applied deceleration exceeds said predetermined level.

17 Claims, 5 Drawing Figures

SHOCK LIMITING APPARATUS

This invention relates to shock absorbing suspension apparatus used to protect delicate downhole instrumentalities from damage due to high shock loading during drilling operations.

In measurement-while-drilling operations, an instrumented cartridge and modulator assembly are suspended or fixed within a drill collar above the bit and typically include components such as a mud-driven alternator/generator, various electronic means for sensing or measuring drilling and formation variables and providing electrical signals indicative thereof, electrical control circuits, and a modulator that affects the flow of drilling fluids through the drill collar in such a manner that acoustic signals are imparted to the fluids having a predetermined relationship to the measured quantities. The acoustic signals are detected at the surface, decoded and displayed. Of course, it will be readily apparent that the downhole cartridge and modulator assembly include a host of delicate electronic and other components which must remain functional during the drilling operation in order to obtain meaningful measurements.

However, the downhole environment in which a drilling tool must operate is known to be quite severe, particularly with respect to shock loading. Shock loading can be due to several circumstances, the drilling of the rock by the bit, jarring, encountering and passing through "bridges" or restricted borehole diameters, and sensing the bottom of the borehole, among others. The magnitude of shock in the axial direction can be extremely large and is limited only by drop height and the elasticity of the impacted formation. For example, for a drop height of 6.75 inches, a velocity at impact of 6 ft/sec. and a rock deflects 0.02 inches plastically under impact, a maximum deceleration of approximately 675 g's will be experienced.

Electronic components has been designed which will withstand shock loads that are quite high, for example, in the range of from 100 to 200 g's, however, it is desirable to protect such components and equipment from excessive shock.

It is the general object of the present invention to provide a new and improved shock limiting apparatus for suspending an instrumented cartridge in a drill collar that functions to limit to an acceptable level the magnitude of axial shock loads that will be applied to the cartridge in connection with the drilling of a well.

This and other objects are attained in accordance with the present invention through the provision of shock limiting apparatus comprising cylinder means fixed inside the drill collar, and piston means movable relative to said cylinder means within limits for mounting an instrumented cartridge in the bore of the drill collar. The piston has its upper side subject to atmospheric or other low pressure, and its lower side subject to the hydrostatic pressure of fluids in the well bore for preventing relative movement unless a predetermined level of deceleration is exceeded. In response to relative movement of the piston means, oil contained in a chamber is displaced through an orifice constructed to provide a substantially constant hydraulic damping force. In addition, other hydro-mechanical centralizing devices for the cartridge may be provided in combination which engage internal wall surfaces of the drill collar and provide sliding deceleration forces due to Coulomb friction, such that the combined effects of hydraulic damping and friction drag act to dissipate kinetic energy of the cartridge in a substantially uniform manner when applied deceleration exceeds said predetermined level. In a preferred form, such deceleration level may be, for example, 50 g's or less.

Springs may be provided to cushion rebound, and an inert gas contained in a chamber may also be provided to supply a pressure to the piston via the oil to prime the same for absorbing shock loads when hydrostatic pressure is too low to achieve the desired effect.

The present invention has other objects, features and advantages that will become more clearly apparent in conjunction with the following detailed description of a preferred embodiment, taken in conjunction with the appended drawings in which.

Figures 1, 3, 4:
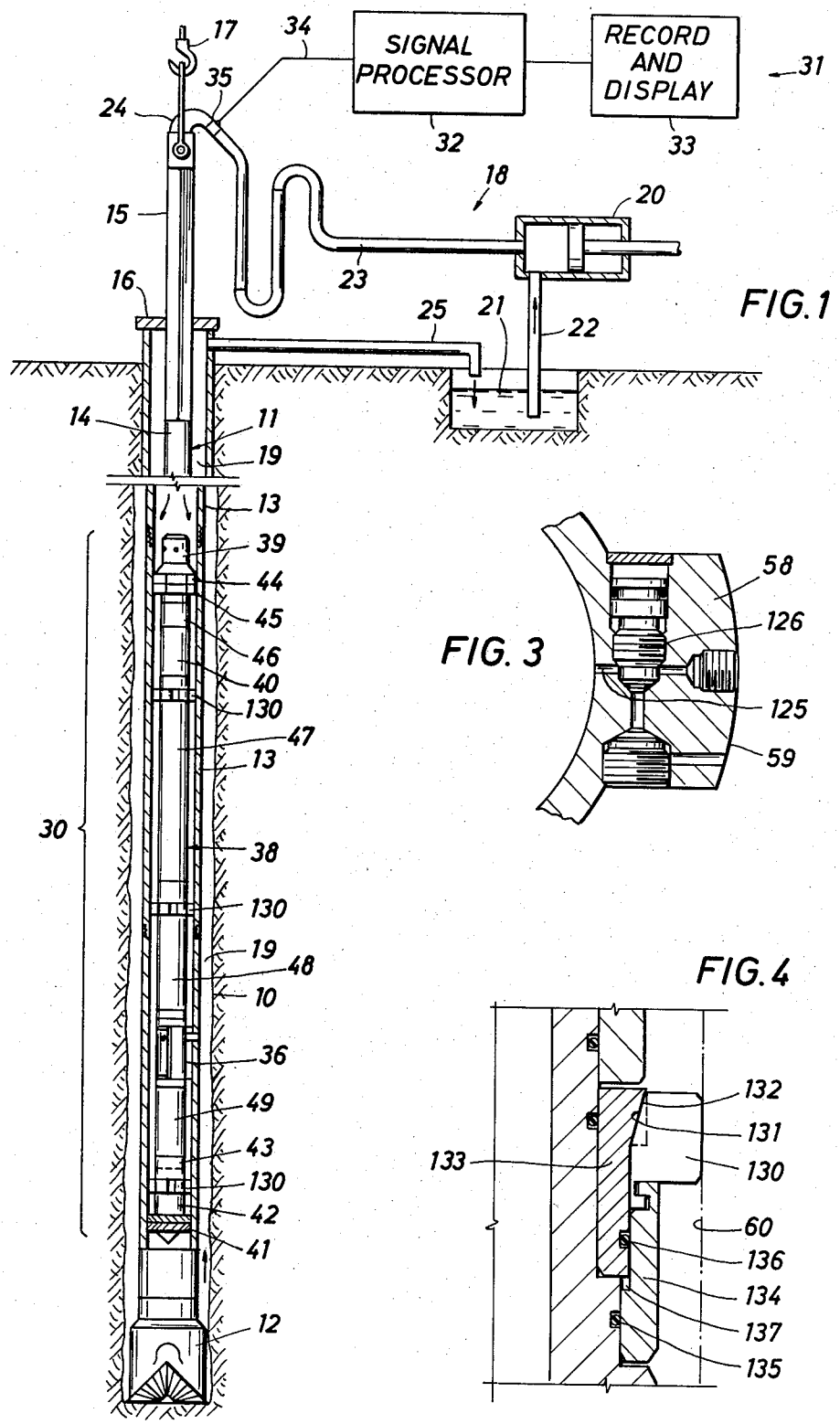
FIG. 1 is a schematic view of a well being drilled by a bit and rotary drilling techniques, and employing measuring-while-drilling tools.
FIG. 3 is a cross-section taken on line 3—3 of FIG. 2B.
FIG. 4 is a fragmentary cross-sectional view of a centralizing latch assembly that may be used in the combination of the present invention.

Referring initially to FIG. 1, a borehole 10 is shown being drilled using rotary drilling techniques. The drill string 11 includes a bit 12, drill collars 13 and a length of drill pipe 14 extending upwardly to the surface. The pipe 14 is connected to a kelly 15 which extends through a rotary drive mechanism 16 which is driven (by equipment not shown) in order to turn the drill string and cause the bit 12 to make hole. The drill string 11 is supported in the borehole 10 by a typical derrick which is represented schematically by a hook 17.

Positioned near the entrance to the borehole 10 is a drilling fluid or "mud" circulating system 18 by which fluids are circulated downwardly through the drill pipe during drilling. The fluids exit through jets in the bit 12 and return to the surface through the annulus 19. The system also includes a mud pump 20 which receives fluids from a pit 21 via a conduit 22, and supplies the fluids through a line 23 and a gooseneck and swivel 24 to the upper end of the kelly 15. Drilling fluids returning from downhole exit through a casing head aperture, and a line 25 transfers the fluids back to the mud pit 21 for recirculation.

A measuring-while-drilling tool indicated generally at 30 is located above the bit 12 and functions to sense downhole drilling and formation conditions and to generate an acoustic signal representative thereof which is imparted to the drilling fluid for communication to the surface. At or near the surface the acoustic signal is detected and processed to provide recordable data. The basic type or acoustic transmission system is well-known and is described in detail in Godbey, U.S. Pat. No. 3,309,656, which is incorporated herein by reference. At the surface, a receiving and decoding system 31 includes a processor 32 and a record and display unit 33 coupled by a line 34 and a pressure transducer 35 to the mud line 23. The modulated signal is monitored by the transducer 35 which generates electrical signals to the processor 32 which decodes the signals into meaningful information representative of the downhole measurements.

The downhole tool assembly 30 comprises an elongated tubular pressure housing 38 made up of individual sections which together constitute an instrumented cartridge that is suspended within one of the drill collars 13 by a shock absorbing and limiting apparatus 36 constructed in accordance with the present invention. The cartridge 38 has at its upper end a modulator 39 having at least a part of the flow of mud passing through it. The modulator 39 is controllably driven by an electric motor 40 for selectively modifying the flow pattern of drilling fluid to thereby impart the acoustic signal to the mud, and the cartridge is provided with sensors for sensing various downhole conditions and control circuits for driving the modulator accordingly. The cartridge 38 also includes a power supply for energizing the circuits, sensors and modulator motor, preferably in the form of a turbine 41 positioned within the mud flow and adapted to drive the rotor of an alternator 42. A regulator 43 regulates the output voltage of the alternator 42 to provide a proper value for use by the various components of the cartridge 38.

The modulator 39 includes a bladed rotor 44 which is mounted above a ported stator 45, whereby rotation of the rotor selectively affects flow of drilling fluid to create pressure pulses in the mud stream constituting an acoustic signal. The rotor is coupled via a gear box 46 to the electric motor 40 which is controlled by circuit means in a telemetry cartridge sub 47 in the manner specified in Bernard et al., U.S. Pat. No. 4,167,000, which is incorporated herein by reference. Downhole variables and conditions such as hole direction (inclination and aximuth of inclination) and naturally occurring gamma radiation, may be continuously monitored during the drilling of the well by appropriate sensors located within the cartridge sections 48 and 49. Sensors on the outside of the drill collar 13 may be provided for measuring formation resistivity and annulus mud temperature, and are connected by conductors to electrical assemblies located within the cartridge 38. Weight-on-bit may be sensed by a sub located between the collar 13 and the bit 12.

Figure 2A:
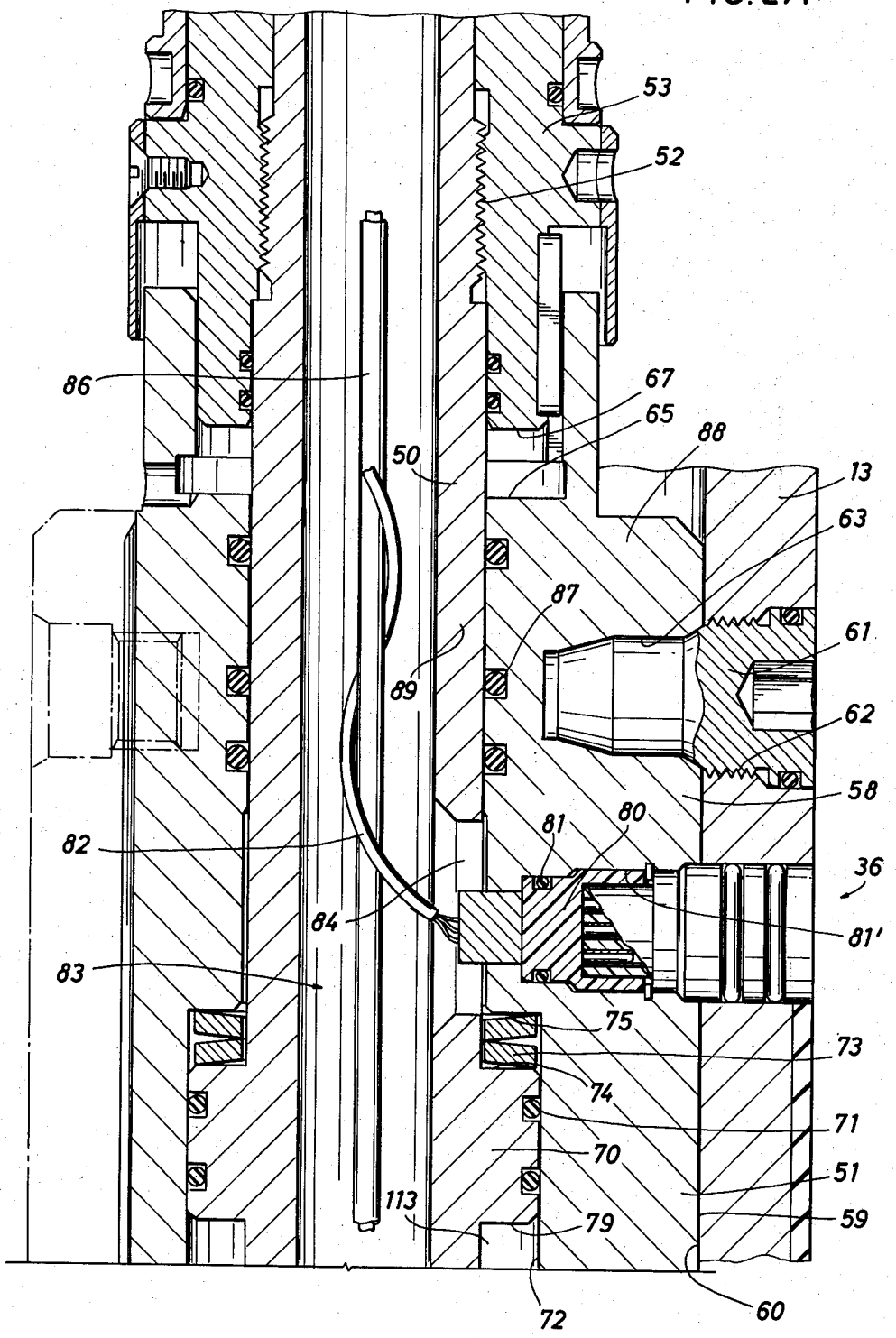
FIGS. 2A and 2B are longitudinal cross-sectional views of a shock limiting and absorbing apparatus of the present invention used to suspend the measuring-while-drilling tool inside the drill collar, FIG. 2B forming a lower continuation of FIG. 2A.
Figure 2B:
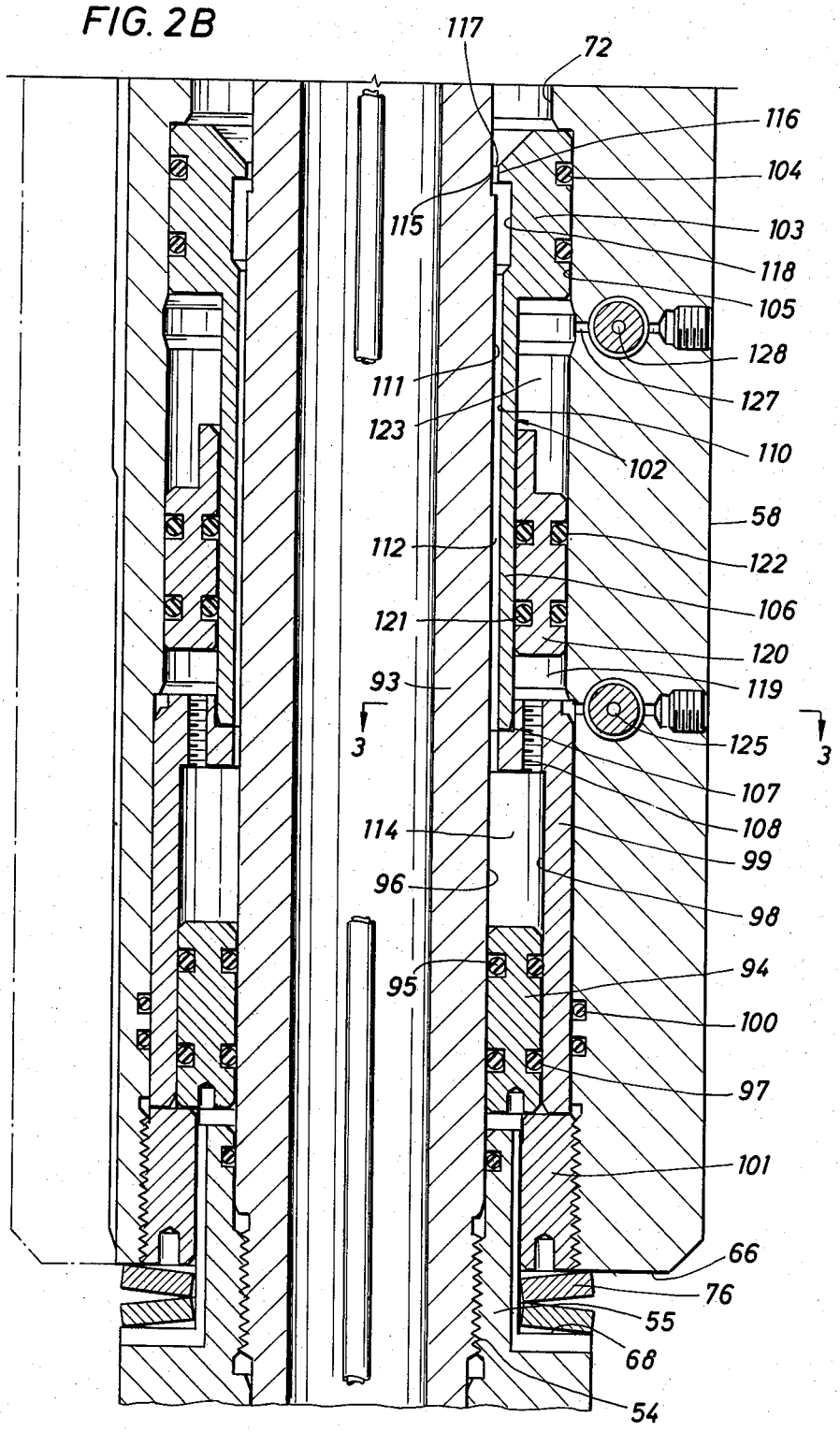

Referring now to FIGS. 2A and 2B for details of the shock absorbing and limiting assembly 36, the assembly comprises an elongated hollow mandrel 50 that extends through a cylinder housing 51. The mandrel has threads 52 and 54 at its upper and lower ends for connecting to adjacent subs 53 and 55 forming parts of the cartridge 38. The threaded joints are sealed by O-rings or the like so that the interior of the mandrel 50 is at atmospheric pressure. The housing 51 is generally tubular in form and has a plurality (for example, three) of longitudinally extending, outward directed ribs 58 as shown in section in FIG. 3. Each rib 58 has an arcuate outer surface 59 adapted to fit closely against the adjacent inner wall surface 60 of the drill collar 13. Suspension pins 61 fitted through threaded apertures 62 in the drill collar 13 extend into respective recesses 63 in each rib 58 and function to attach the housing 51 securely to the collar. The spaces between the ribs 58 provide longitudinal passages for drilling fluids flowing through the drill collar 13. The upper and lower end surfaces 65 and 66 of the housing 51 are axially spaced with respect to adjacent end surfaces 67 and 68 of the subs 53 and 55 so that the mandrel 50 is, within limits, movable longitudinally relative to the housing.

A piston head 70 is provided by an outwardly directed flange of the mandrel 50 and is sealed by O-rings 71 against a cylinder wall surface 72 on the housing 51. Several Bellville washers 73 or the like are positioned between the upper surface 74 of the piston heat 70 and a downwardly facing shoulder 75 on the housing 51, and lower washers 76 are located between opposed surfaces 66 and 68 on the lower end of the housing 51 and on the sub 55, respectively. An electrical conductor feed-through plug 80 sealed by an O-ring 81 is retained within a socket 81' extending through the wall of the housing 51 to provide a connection between conductor wires 82 in the bore 83 of the mandrel 50 and wires leading to sensors located externally of, as well as below, the drill collar 13. The wires 82 extend through an elongated slot 84 formed through the wall of the mandrel 50 above the piston head 70 and may have coils therein, as shown, to facilitate longitudinal relative movement. An electric cable 86 is shown extending through the bore 83 of the mandrel 50 for providing connection between various components of the cartridge assembly 38. O-ring seals 87 prevent fluid leakage of drilling fluids between the upper portion 88 of the housing 51 and the adjacent portion 89 of the mandrel 50. The bore of the mandrel 50 is entirely sealed off from ambient well fluid pressure and thus the upper surface 74 of the piston head 70 is subject to atmospheric pressure via the slot 84.

An annular cavity is formed between the lower portion 93 of the mandrel 50 and the housing 51, with the upper end of the cavity being closed by the piston head 70 and the lower end thereof being closed by an annular, movable partition 94 having inner seal rings 95 slidably engaging the outer wall 96 of the mandrel 50 and outer seal rings 97 slidably engaging the inner wall surface 98 of a lower sleeve 99. O-rings 100 prevent fluid leakage between the sleeve 99 and the housing 51, and the partition 94 and the sleeve 99 are retained by a stop ring 101 threaded into the lower end of the housing. An upper sleeve 102 has an enlarged head 103 sealed by O-rings 104 against an adjacent inner wall surface 105 of the housing 51, and a reduced diameter skirt 106 having its lower end fitted into a counter-bore 107 in the upper end of the lower sleeve 99. The lower sleeve is provided with a plurality of axially extending flow ports 108 extending through the upper portion thereof.

The inner wall surface 110 of the upper sleeve 102 is spaced laterally outwardly from the outer wall surface 111 of the mandrel 50 to provide an annular flow passage 112 that communicates the region 113 of the chamber below the piston head 70 with the region 114 of the chamber inside the lower sleeve 99. An external surface 115 of the mandrel 50 adjacent the head 103 of the sleeve 102 is inclined downwardly and inwardly to define together with the inner surface 116 of the head an annular orifice 117 of cross-section area that changes as the mandrel 50 moves axially relative to the housing 51. In the configuration shown, the orifice area is a maximum at the upper position of the mandrel 50, and gradually is reduced as the mandrel shifts downwardly relative to the head 103 of the sleeve 102. An internal annular recess 118 may be formed below the surface 116 on the sleeve 102 to further define the annular orifice 117. The flow ports 108 in the lower sleeve 99 have an aggregate cross-sectional area in excess of the maximum flow area of the annular orifice 117, and communicate with a third region 119 of the chamber below an annular floating partition 120 that carries inner and outer seals 121 and 122. The partition 122 and the upper fixed sleeve 102 define the ends and inner walls of a fourth region 123 of the chamber.

A fill port 125 in one of the ribs 58 enables the chamber except for the region 123 to be filled with a substantially noncompressible liquid such as suitable oil. As shown in FIG. 3, the port 125 can be opened and closed by a threaded valve plug 126. An upper port 127 in the rib 58 enables the chamber region 123 to have injected therein a suitable inert gas such as nitrogen under pressure. This port 127 also is provided with a closure valve 128.

Referring again to FIG. 1, one or more vertically spaced sets of outwardly shiftable latches 130 distributed circumferentially around the outside of the cartridge 38 preferably are used to centralize the cartridge within the bore of the drill collar 13. As shown in detail in FIG. 4, the latches each have an inner inclined surface 131 that slidably engages a companion inclined surface 132 on an expander ring 133, and are mounted for lateral movement on the upper end of a vertically shiftable piston ring 134. Seal rings 135, 136 isolate an annular chamber 137 at atmospheric or other low pressure, so that outward pressure of the latches against the inner wall surface 60 of the drill collar 13 is a function of the hydrostatic pressure of the ambient well fluids. Alternatively, the latches could comprise radially movable pistons having stepped diameters to provide a sealed atmospheric chamber to enable hydrostatic pressure to exert radial force thereon to cause centralizing of the cartridge 38. In either case, the latches 130 when pressed against the inner walls of the drill collar 13 provide a Coulomb friction force resisting axial movement of the cartridge 38 relative to the collar.

In operation, the shock limiter apparatus 36 is assembled together with the cartridge 38 as shown in the drawings. Nitrogen is injected under pressure into the chamber region 123 via the port 127, then the balance of the chamber area is filled with oil via the port 125. The pressure of the nitrogen is transmitted to the oil via the partition 120 to prime the assembly for downward shock in the absence of hydrostatic pressure or as long as hydrostatic pressure in less than ambient well pressure. Of course, as the tool is lowered into a fluid-filled well bore, hydrostatic pressure transmitted to the oil by the lower partition 94 and acting on the lower face 79 of the piston 70 will cause the upper partition 120 to shift upwardly, raising inert gas pressure in the region 123 until the partition shoulders out against the sleeve head 103, whereby hydrostatic pressure provides at a fairly shallow depth a principle decelerating force acting on the piston head 70. The nitrogen gas pressure then will have no further role in shock protection. The assembly is inserted into the drill collar 13 and the radial pins 61 inserted for suspension. A plug engaged with the receptacle 80 leads conductor wires to external sensors on the drill collar, or to other sensors located between the drill collar and the bit 12.

Should the drill collar 13 be suddenly stopped during descent into the well bore, for example, on encountering a "bridge" or the bottom of the borehole or the like, the shock limiter apparatus functions to limit the maximum deceleration that is applied to the tool 38 and its sensitive electrical and mechanical components to an acceptable level of, for example, 50 g., as follows. The device uses three modes for limiting the acceleration or deceleration level, which may be considered as three forces: an upward force due to hydrostatic pressure acting on the lower face 79 of the piston head 70; damping force due to oil being pumped through the annular orifice 117 during movement of the mandrel 50 relative to he housing 51; and damping force due to Coulomb friction of the locking devices 130 against the inner wall surface 60 of the drill collar 13. The hydrostatic pressure of the well fluids acts upwardly against the bottom surface of the lower partition 94 and is transmitted thereby to the oil filling the chamber. Thus, hydrostatic pressure acts upwardly on the lower face 79 of the piston 70 and applies upward force to the mandrel 50 that is the product of such pressure (the upper face of the piston being subject to atmospheric pressure) and the transverse cross-sectional area of the piston head 70. Such upward force prevents downward movement of the piston 70 relative to the housing 51, and corresponding relative movement between the cartridge 38 and the drill collar 13, unless a predetermined level, for example, about 50 g., of deceleration is exceeded. When such level is exceeded, the instrumentality 38 can move downward with its kinetic energy being dissipated through the action of the dumping orifice 117 and the centralizing latches 130. As the piston head 70 moves downwardly along the cylinder wall 72, oil is displaced from the chamber region 113 to the chamber region 114 via the annular orifice 117, so that a damping force reacts upwardly on the piston head that is a function of the vertical velocity of the cartridge, the viscosity of the oil, the pressure drop across the orifice and a characteristic orifice constant. The resistance to sliding of the centralizing devices 130 along the internal drill collar wall is related to the hydrostatic well pressure, the unbalanced area of the piston 134 and a characteristic coefficient of friction.

The Coulomb friction and hydrostatic pressure forces increase with well depth, but may be considered constant for any given conditions. The variable area of the annular orifice 117 and resulting nonlinear relationship between pressure drop across the orifice and velocity of downward movement of the mandrel 50 provides a substantially constant orifice damping force. Thus, the dissipation of the kinetic energy of the instrumentality 38 due to hydraulic damping and friction drag is substantially uniform as the piston 70 moves downwardly and then upwardly to its rest position with respect to the housing 51. The hydrostatic force acting upwardly on the piston head 70 does not change direction at the bottom of the stroke of the mandrel 50, as do the Coulomb friction and the hydraulic damping forces, whereby the hydrostatic force will return the mandrel to the upper position shown in FIG. 2. The Bellville washers 73 and 76 act to cushion the upward shock of the return stroke, which will be much less than the initial shock due to kinetic energy dissipation. The apparatus of the present invention operates in substantially the same manner should it be necessary to subject the drill collar 13 to upward shock loading through the action of a drilling jar, the actuation of which may be necessary should the drill string become stuck in the well below the level of the shock limiter apparatus 36. Thus, it will be recognized that the assembly operates when jarring upward to limit the level of upward acceleration of the cartridge 38.

It now will be recognized that a new and improved shock limiting apparatus for suspending a measuring-while-drilling tool within a drill collar has been provided. The apparatus functions to limit to an acceptable level the magnitude of vertical acceleration or deceleration that will be applied to the tool due to shock loading during the drilling of a well. Since certain changes or modifications may be made to the disclosed embodiment by those skilled in the art without departing from the inventive concepts involved, it is the aim of the appended claims to cover all such changes and modifications falling within the true spirit and scope of the present invention.

We claim:

1. Apparatus for use in mounting an instrumentality in a drill collar or the like and limiting axial shock loads that may be applied to such instrumentality, comprising: first and second relatively movable members defining low pressure chamber, one of said members being adapted for attachment to a drill collar and the other of said members being connected with said instrumentality, said other member having a transverse pressure area subject on one side to said low pressure and on the other side to the hydrostatic pressure of fluids in a well to prevent relative movement of said members unless a predetermined level of deceleration is exceeded; and means for dissipating kinetic energy of said instrumentality in a substantially uniform manner when applied deceleration exceeds said predetermined level.

2. The apparatus of claim 1 wherein said dissipating means includes means responsive to relative movement of said members for displacing fluid through an orifice to provide a hydraulic damping force.

3. The apparatus of claim 2 wherein said dissipating means further includes means on said instrumentality adapted to frictionally engage internal wall surfaces of a drill collar with a predetermined pressure to provide a mechanical drag force.

4. The apparatus of claim 2 wherein said orifice has a cross-sectional area that varies with relative movement of said members in a manner to provide a substantially constant damping force.

5. The apparatus of claim 1 further including spring means reacting between said members for cushioning rebound of said instrumentality as the same is returned to rest by the force on said other member due to hydrostatic pressure.

6. Apparatus for use in mounting an instrumentality in a drill collar and limiting shock loads that may be applied to such instrumentality, comprising: cylinder means adapted to be fixed to a drill collar; piston means connected with said instrumentality and sealingly slidable within limits with respect to said cylinder means, the upper face of said piston means being subject to atmospheric pressure; means for subjecting the lower face of said piston means to the hydrostatic pressure of well fluids, whereby the pressure of well fluids acting on said piston means prevents movement of said piston and cylinder means relative to one another unless a predetermined level of acceleration or deceleration is applied to said instrumentality; and means for dissipating kinetic energy of said instrumentality in a substantially uniform manner when applied acceleration or deceleration exceeds said predetermined level.

7. The apparatus of claim 6 wherein said dissipating means includes means responsive to axial movement of said piston means with respect to said cylinder means for displacing hydraulic fluid through an orifice to provide hydraulic damping.

8. The apparatus of claim 7 wherein said dissipating means further includes means operatively associated with said instrumentality and adapted to frictionally engage internal wall surfaces of a drill collar to provide a mechanical drag force.

9. The apparatus of claim 7 wherein said orifice has a cross-sectional area that varies with relative movement of said piston and cylinder means to provide a substantially constant damping force.

10. The apparatus of claim 6 further including spring means reacting between said cylinder means and said piston means for cushioning rebound of said instrumentality as the same is returned to rest by hydrostatic pressure acting on said piston means.

11. Apparatus for use in mounting an instrumentality in a drill collar and limiting shock loads that may be applied to such instrumentality, comprising: housing means adapted to be fixed rigidly to a drill collar within the bore thereof and having internal cylinder means; a mandrel adapted to be connected to said instrumentality and extending through said housing means, said mandrel having piston means sealingly engaging said cylinder means, said mandrel and housing means movable longitudinally within limits relative to one another; means defining a fluid filled annular chamber between said mandrel and said housing means below said piston means; means for subjecting the upper face of said piston means to atmospheric pressure; means for transmitting the hydrostatic pressure of well fluids to a fluid filling said chamber to thereby subject the lower face of said piston means to hydrostatic pressure for preventing movement of said mandrel relative to said housing means unless a predetermined level of deceleration force is applied to said instrumentality; and means active during relative movement of said mandrel and housing means for dissipating kinetic energy of said instrumentality in a substantially uniform manner when said predetermined level of deceleration force is exceeded.

12. The apparatus of claim 11 wherein said dissipating means includes variable area orifice means through which the fluid in said chamber passes during movement of said piston means relative to said housing means to provide hydraulic damping.

13. The apparatus of claim 11 further including means providing a minimum pressure for fluid filling said annular chamber to prime said apparatus for operation when hydrostatic pressure is less than said minimum pressure.

14. The apparatus of claim 11 further including centralizing means on said instrumentality spaced from said housing means and adapted to frictionally engage internal wall surfaces of a drill collar to provide a mechanical drag force retarding relative movement of said mandrel and housing means.

15. The apparatus of claim 14 wherein said centralizing means presses against the wall surfaces of a drill collar with a pressure dependent upon the hydrostatic pressure of fluids in a well.

16. The apparatus of claim 11 further including spring means reacting between said mandrel and said housing means for cushioning rebound of said instrumentality during upward movement of said mandrel relative to said housing means.

17. Apparatus for use in making measurements during the drilling of a well, comprising a tubular body adapted to be connected in a drill string; an instrumentality including means for making said measurements; and means for mounting said instrumentality within said tubular body including means responsive to a combination of hydrostatic pressure force, orifice damping force and Coulomb friction force for limiting to a predetermined level the magnitude of acceleration and deceleration forces to which said instrumentality may be subjected when said tubular member is subjected to an axial shock load.

* * * * *